United States Patent [19]

Solomon

[11] 4,401,978

[45] Aug. 30, 1983

[54] COMBINATION DETECTOR

[75] Inventor: Elias E. Solomon, Duxbury, Mass.

[73] Assignee: The Gamewell Corporation, Medway, Mass.

[21] Appl. No.: 259,373

[22] Filed: May 1, 1981

Related U.S. Application Data

[63] Continuation of Ser. No. 13,398, Feb. 21, 1979, abandoned.

[51] Int. Cl.[3] ..... G08B 17/10

[52] U.S. Cl. ..... 340/628; 340/629; 340/630

[58] Field of Search ..... 340/628, 629, 630, 600, 340/521

[56] References Cited

U.S. PATENT DOCUMENTS

| | | | |
|---|---|---|---|
| 2,825,894 | 3/1958 | Marmorstone | 340/521 |
| 3,611,365 | 10/1971 | Lundquist et al. | 340/600 |
| 3,801,972 | 4/1974 | Hokim et al. | 340/628 X |
| 3,866,195 | 2/1975 | Ried, Jr. | 340/629 |
| 3,868,663 | 2/1975 | Ray | 340/629 X |
| 3,909,813 | 9/1975 | Scheidweiler et al. | 340/629 X |

FOREIGN PATENT DOCUMENTS

| | | | |
|---|---|---|---|
| 2452839 | 5/1975 | Fed. Rep. of Germany | 340/521 |
| 2615412 | 10/1976 | Fed. Rep. of Germany | 340/629 |
| 52-29288 | 3/1977 | Japan | 340/630 |

*Primary Examiner*—John W. Caldwell, Sr.
*Assistant Examiner*—Daniel Myer
*Attorney, Agent, or Firm*—Wolf, Greenfield & Sacks

[57] ABSTRACT

A combination optical and ionization detector for providing a more complete range of detection including detection of larger particles of combustion and smaller sub-micron particulates. Each detection channel (optical and ionization) may be independently calibrated and each has means such as an indicator light to identify which channel has alarmed. Each channel has detection circuitry for establishing both a pre-alarm condition and a full alarm condition. Differing alarm states are determined by the generation of audibly or visually distinguishable signals. For example a short signal may indicate a pre-alarm condition while a long, coded or modulated signal may indicate a full alarm condition. A further distinctive signal may indicate activation of two or more detectors. A supervisory channel may also be provided to detect, for example, circuit component failure. Preferably there is an adjustable delay period before either a pre-alarm or full alarm is signaled with the adjustable period being reset to zero if the alarm condition is interrupted.

12 Claims, 8 Drawing Figures

COMBINATION DETECTOR

This is a continuation of application Ser. No. 13,398, filed Feb. 21, 1979, now abandoned.

BACKGROUND OF THE INVENTION

The present invention relates in general to a fire and smoke detector, and more particularly, to a combination detector that combines in a single unit both optical and ionization forms of detection.

Each form of detection has its own range of sensitivities. For example, optical detectors are more responsive to larger particles of combustion while ionization detectors are more sensitive to smaller sub-micron particulates. Gas-type detectors respond primarily to hydrocarbon gases and are generally insensitive to particulates.

Thus, one of the advantages of the detector of this invention is its greater spectrum of sensitivity. In this way with a combination detector, virtually all major fire hazards are covered.

Accordingly, one object of the present invention is to provide a combination detector including both optical and ionization detection sections.

Another object of the present invention is to provide a combination detector that is not expensive and that has relatively few components so that it can be accommodated in a relatively aesthetically appealing unit.

Another object of the present invention is to provide a combination detector that provides both a pre-alarm condition and a full alarm condition.

Still another object of the present invention is to provide a combination detector that distinguishes between certain different alarm conditions such as a pre-alarm and a full alarm condition or detection at one or more than one detector.

SUMMARY OF THE INVENTION

To accomplish the foregoing and other objects of this invention there is provided a combination detector for detecting smoke or fire conditions. This combination detector includes optical detection apparatus comprising an optical sensor and circuitry for sensing activation of the optical sensor. There is also provided an ionization detection apparatus comprising an ionization sensor (chamber) and circuitry for sensing activation of the ionization sensor. Combination detector also includes alarm generating means and means for coupling both the optical and ionization detection circuitry to the alarm generating means. The alarm generating means includes circuitry responsive to at least one of either the ionization or the optical detection circuitry for establishing an alarm condition. In accordance with the invention the optical detection apparatus may comprise one channel while the ionization detection apparatus comprises a second channel. Each of these channels may be separately calibrated and the alarm signals that are generated identify which of the apparatus has been activated. But each channel has detection circuitry for establishing both a pre-alarm condition and a full alarm condition. Different alarm states are determined by generation of either audibly or visually distinguishable signals. For example, a signal of a first perhaps short duration may indicate a pre-alarm condition while a longer signal or a signal that is coded or modulated may indicate a full alarm condition. A further distinctive signal may indicate activation of both detectors. In accordance with the invention there is also preferably provided a supervisory channel that can be associated with each detector. This supervisory channel may be for detecting component failure. Another feature in accordance with the invention is the use of a delay or integrator which permits an alarm condition only after a predetermined delay period. Also, in accordance with this feature the delay period is preferably immediately resettable should the alarm signal be interrupted.

BRIEF DESCRIPTION OF THE DRAWINGS

Numerous other objects, features and advantages of the invention should now become apparent upon a reading of the following detailed description taken in conjunction with the accompanying drawings in which.

DETAILED DESCRIPTION

The purpose of the present invention is to provide a combination detector that combines optical detection apparatus and ionization detection apparatus. A typical prior art ionization detector is shown in my U.S. Pat. No. 4,121,105. Such an ionization detector typically comprises an ionization chamber, an impedance converter and an adjustable trigger circuit. When particles of combustion enter the chamber, the voltage across the detection chamber is altered usually by being increased causing the alarm comparator to trigger.

An optical detector is disclosed in my co-pending application Ser. No. 782,002, now abandoned. Such an optical detector typically includes an optical source and associated optical detector for the detection of smoke particles. The optical detector may comprise a phototransistor or the like connected to an amplifier that is used to provide the necessary gain. The output of the amplifier then typically connects to an alarm comparator which is triggered upon receipt of the smoke particles to the apparatus.

These two types of detectors are combined in accordance with the present invention into a single unit but with each detector being capable of being calibrated separately. In accordance with one feature of the invention the alarm conditions from each detector are identified as to their source of origin. There are provided a series of different distinguishable alarm conditions depending upon the type of alarm that has occurred. For example, there may be distinguishable signals to distinguish between the optical alarm and ionization alarm. Furthermore, there may be distinctive signals that distinguish between a pre-alarm condition and a full alarm condition. There may also be a further distinctive signal for indicating failure of critical components of the system.

Figure 1A:
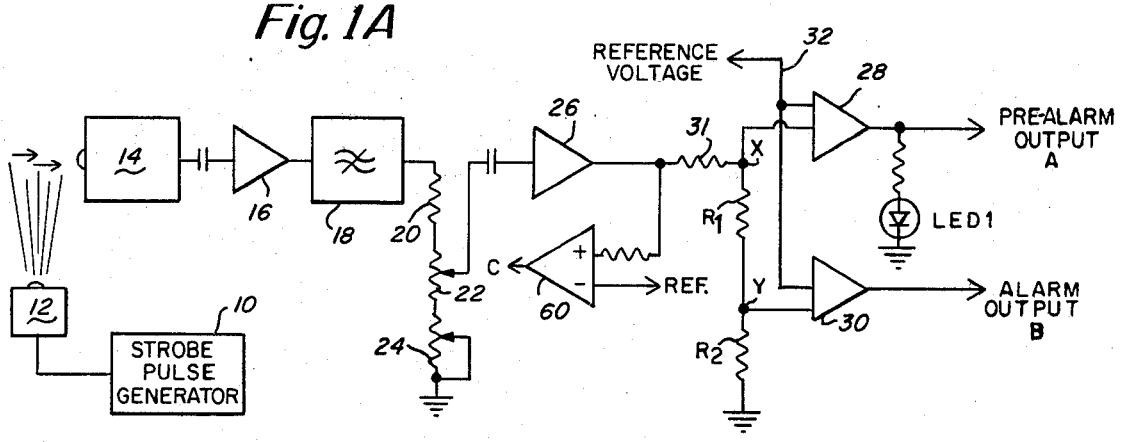
FIG. 1A shows optical detection apparatus in accordance with the present invention including circuitry for generating both a pre-alarm condition and a full alarm condition.

FIG. 1A shows a section of the optical detector of this invention. The circuit block diagram of FIG. 1A shows a strobe pulse generator 10 which couples to an optical transmitting transducer 12 such as a Gallium Arsenide or Gallium Phosphide optical emitter. The combination of the generator 10 and the transducer 12 may be an arrangement described in my U.S. Pat. Nos. 4,126,790 and 4,121,110.

The diagram of FIG. 1A also includes an optical receiver transducer 14 which may be a photo diode or silicon photo cell. The arrangement of transducers 12 and 14 may be as disclosed in my U.S. Pat. Nos. 4,126,790 and 4,121,110.

The output from the transducer 14 may AC couple to the amplifier 16. The output of the amplifier 16 couples to a filter 18 which may be either a conventional high pass or band pass filter. The filter 18 is for the rejection of extraneous optical signals and low frequency power generated signals such as the 60 Hertz signal and its harmonics. The output from the filter 18 couples to a resistive network comprising, in series, a fixed resistor 20, and potentiometers 22 and 24. The potentiometer 22 is for calibrating the detector to the desired sensitivity. The lower potentiometer 24 is for a further fine adjustment after the potentiometer 22 has been set. The potentiometer 22 may have a full value of 10,000 ohms while the potentiometer 24 may have a value a fraction of that resistance of say 1,000 ohms. The movable arm of potentiometer 22 is AC copuled to a further amplifier 26 which may possibly be omitted if the gain of the circuit is sufficient.

Figure 1B:
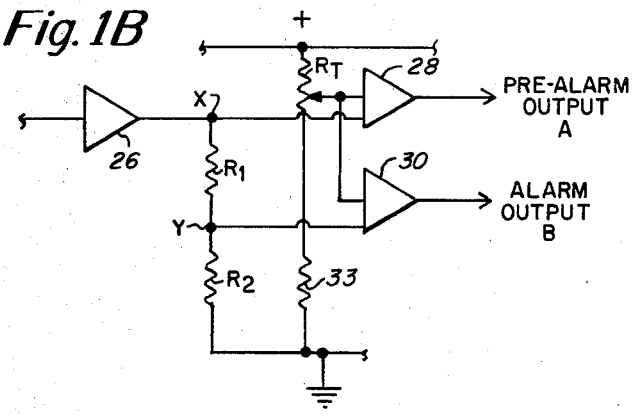
FIG. 1B shows an alternate arrangement for a portion of the circuitry of FIG. 1A.

The output from amplifier 26 couples by way of a further resistive network to threshhold detectors or comparators 28 and 30. This second resistive network includes resistor 31 and resistors R1 and R2. In this embodiment, one of the inputs to each comparator is tied to the same reference voltage by means of the reference voltage line 32. The resistor network including resistors R1 and R2 sets the voltage at node X greater than the voltage at node Y. Thus, the comparator 28 will trigger before the comparator 30 assuming an increased voltage signal to the resistive network. The resistors R1 and R2 may be chosen so that the comparator 28 triggers at a predetermined percentage in comparison with the triggering of comparator 30. For example, if it is desired to obtain advance notice of an alarm from a detector before an actual alarm is given, comparator 28 may be set to trigger at say 75% of the voltage value necessary to trigger the other comparator 30. Thus, it is possible to sense a pre-alarm condition before a general or full alarm is sounded and thus also before something more drastic happens such as the application of automatic extinguishing agents such as Halon. FIG. 1B shows an alternate arrangement for a portion of the circuit of FIG. 1A. In FIG. 1B there is shown the amplifier 26. The input to the circuit of FIG. 1B may be the same as the input shown in FIG. 1A including the source 12, generator 10, transducer 14, amplifier 16, and filter 18. In FIG. 1B the output from amplifier 26 feeds a resistive network comprising resistors R1 and R2. The nodes X and Y couple to respective inputs of the comparators 28 and 30. The output A from comparator 28 is the pre-alarm output and the output B from comparator 30 is the full alarm output. The primary difference between the embodiment of FIG. 1B and the one of FIG. 1A is in the use of an adjustable threshhold which is adjustable by means of the potentiometer RT which is used in combination with the resistor 33. The movable arm of the potentiometer RT couples to the reference inputs of the comparators 28 and 30. Thus, the threshhold of the comparators 28 and 30 is adjustable but the voltage at node X still reaches the threshhold value before the voltage at the node Y thus providing both the pre-alarm and full alarm conditions.

Figure 1C:
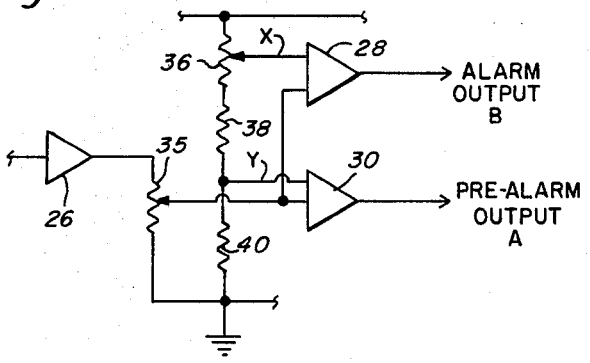
FIG. 1C shows still a further alternative embodiment of a portion of the circuitry of FIG. 1A.

FIG. 1C shows a further alternate inversion of the present invention. Again, with the embodiment of FIG. 1C the input circuitry may be identical to that shown in FIG. 1A. FIG. 1C shows the circuitry from amplifier 26 whose output couples to potentiometer 35. The fixed ends of the potentiometer couple between the output of amplifier 26 and for example, ground level. The movable arm of the potentiometer couples in common to one input of each of the comparators 28 and 30. In the arrangement of FIG. 1C the threshholds are two different threshholds which may be adjustable independently. These threshholds are established by the resistive network including potentiometer 36, and resistors 38 and 40. Actually, resistor 38 could also be replaced by a potentiometer or resistor 40 could be replaced by a potentiometer. In the arrangement of FIG. 1C the potentiometer 36 is adjustable to set the ratio of the threshhold of the comparators 28 and 30. Because the voltage on line X is greater than the voltage on line Y the comparator 30 is triggered in this arrangement prior to the triggering of the comparator 28. Thus, the output of comparator 30 is shown as the output A or pre-alarm output. The output of comparator 28 is the corresponding full alarm or B output.

Figure 2:
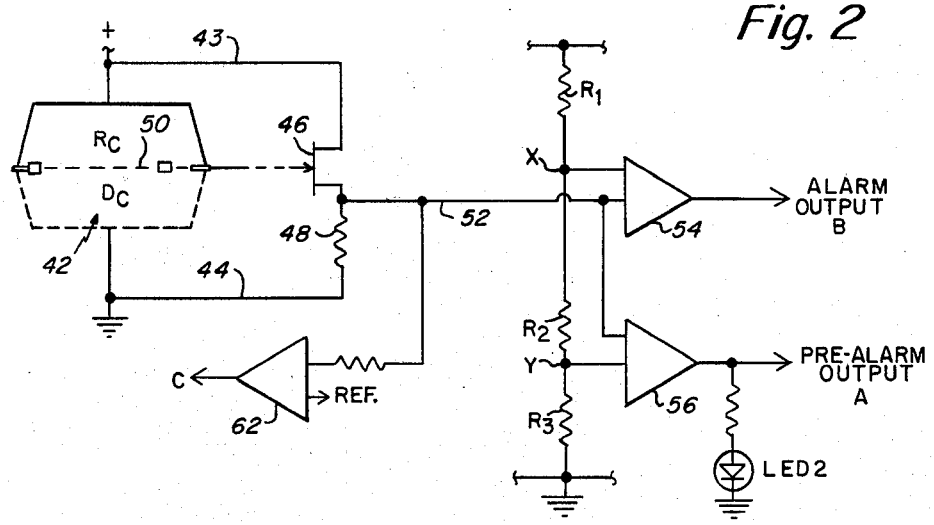
FIG. 2 shows the ionization detection apparatus in accordance with the present invention also showing circuitry for generating both a pre-alarm condition and a full alarm condition.

FIGS. 1A-1C have described different versions for the optical detection portion of the detector. Both pre-alarm and full alarm outputs are also identified with regard to the ionization portion of the combination detector. FIG. 2 shows a simplified ionization detector system in combination with dual comparators. In FIG. 2 there is shown an ionization chamber 42 which may be of the type described in either of my U.S. Pat. Nos. 4,021,671 and 4,121,105. This chamber typically includes a detection chamber DC and a reference chamber RC. The chamber connects between opposite polarity lines 43 and 44. These lines also connect to the impedance converter including an FET source follower 46 and associated resistor 48. The common electrode 50 of the chamber couples to the input electrode of the source follower 46. The output from the source follower is taken at one of the two output electrodes on line 52 which couples to both like inputs of comparators 54 and 56. The comparator arrangement and the associated resistive network of FIG. 2 is like the one shown in FIG. 1C including resistors R1, R2 and R3 connected in series. In this arrangement the voltage at the node X between the resistors R1 and R2 is set at a greater value than the voltage at the node Y between the resistors R2 and R3. Thus, the comparator 56 gives the pre-alarm output condition while the comparator 54 gives the full alarm output condition. Any one or more of the resistors R1, R2 and R3 may also include a potentiometer.

When smoke enters the chamber 42, the voltage at the output of the FET source follower 46 increases to a sufficient value to trigger the comparator 56. This is a pre-alarm condition on output A. At a higher voltage level determined by the scaling resistors R1, R2 and R3, the comparator 54 becomes triggered providing the output B or full alarm output.

In another embodiment of the invention the configuration of the chamber 42 may be altered by essentially interchanging the reference and detection chambers. With such an arrangement there would be a decrease in voltage at the output of the source follower 46 when smoke particles are detected. In this case the comparators may be arranged to trip when the voltage decreases to below a predetermined level. Thus, comparator 54 will trip before comparator 56 as the voltage on line 52 will drop to the voltage at node X before it will reach the voltage at node Y. In such an embodiment the comparator 54 then becomes the pre-alarm comparator and the comparator 56 is the main or full alarm comparator.

The comparator arrangements shown in FIGS. 1A and 1B may also be applied to the circuit of FIG. 2. This is accomplished by scaling the signal on line 52 rather than scaling the reference signals.

Another feature in accordance with the invention is the use of illuminating means for showing the pre-alarm condition For example, in FIG. 1A there is shown an LED-1 coupled to the output of comparator 28 for denoting a pre-alarm condition with regard to the optical detection section. Similarly, there is an LED-2 shown in FIG. 2 for showing a pre-alarm condition with regard to the ionization detection circuit. Thus, a visible indication is given of the pre-alarm status of each of the detectors (optical and ionization).

Another feature of the present invention is the ability to signal a trouble or fault condition. In this connection reference is made in FIG. 1A to comparator 60 which may have one input coupled from the output of amplifier 26 and a second reference input that can be tied to a suitable reference voltage. The comparator 60 may be set to trip if the voltage from the amplifier 26 falls below a preset level. This may be caused by, for example, failure of the transmitter 12, or could also be caused by a circuit component failure or reduction in energy radiated due to dust or temperature changes. With regard to an ionization detector the fault could be generated by means of an inoperative source that may be contaminated. In this regard note the comparator 62 shown in FIG. 2 which has a reference input and also a second sensing input coupled from line 52. Both the comparator 60 of FIG. 1 and the comparator 62 of FIG. 2 are shown as having their outputs coupled to a line or output C. This may be referred to as the supervisory (trouble) output. The outputs A, B and C shown in FIGS. 1A and FIG. 2 are also designations employed in the diagram of FIG. 3. For the comparator 62 of FIG. 2, the comparator will trip if the voltage on line 52 decreases due to conditions effecting the sensitivity such as a contaminated radioactive source within the chamber 42.

Figure 3:
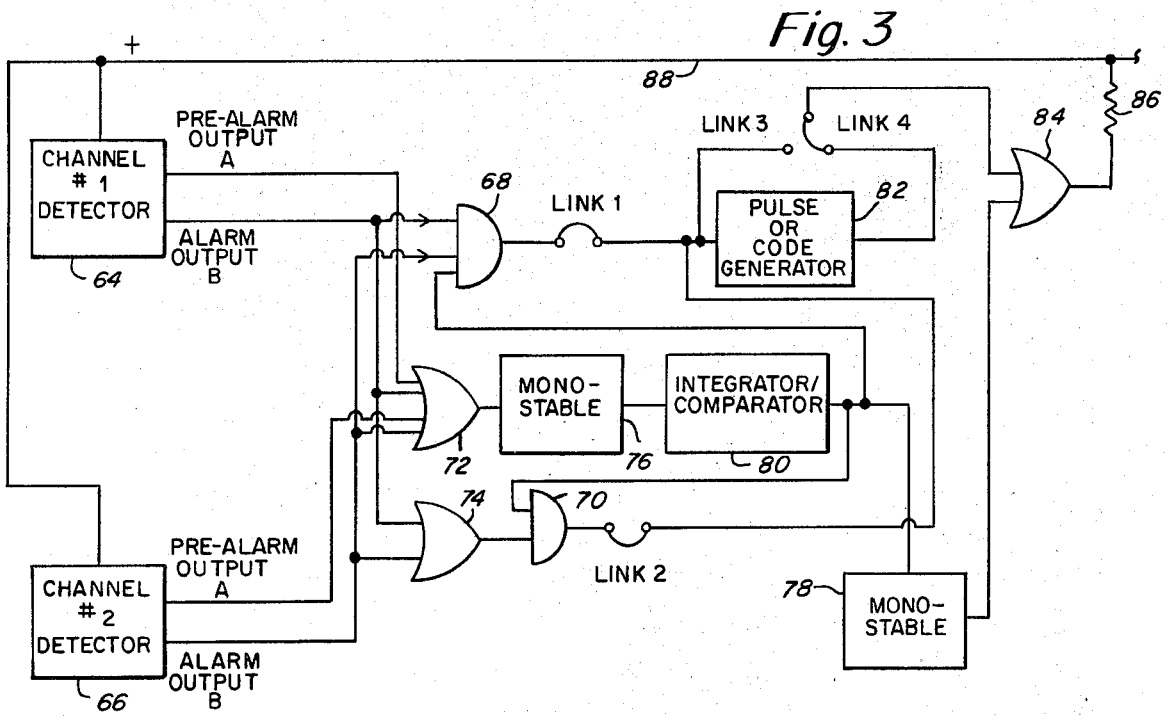
FIG. 3 is a logic circuit diagram showing two detectors (channels) and the logic circuitry for generating certain distinguishable alarm conditions.

FIG. 3 is a complete block diagram of a combination detector in accordance with the invention including two channels, one associated with an optical detector and the other associated with an ionization detector. Although, in accordance with the preferred embodiment, the two different channels are optical and ionization, other forms of detection could also be employed. In FIG. 3 there is shown a first channel detector 64 and a second channel detector 66. The detector 64 may comprise the apparatus shown in FIG. 1A while the second detector 66 may comprise the apparatus shown in FIG. 2. In FIG. 3 these outputs from the detectors 64 and 66 are labeled as A and B outputs corresponding to the A and B output signals shown in FIGS. 1A and FIG. 2. The output C also shown in FIGS. 1A and 2 may be tied into the system of FIG. 3 but is not shown in the basic system (see FIG. 8).

In FIG. 3 the remainder of the system includes AND gate 68, AND gate 70, OR gates 72 and 74, monostable devices 76 and 78, integrator 80, code or pulse generator 82, and OR gate 84. This logic and block circuitry essentially connects from the output of the detectors 64 and 66 by way of resistor 86 to the voltage line 88 which may be a positive voltage line. In FIG. 3 there are also interconnecting links described in detail hereinafter. The output from gate 84 may also signal certain alarm conditions, discussed hereinafter, by way of a separate alarm generating line.

Figure 4:
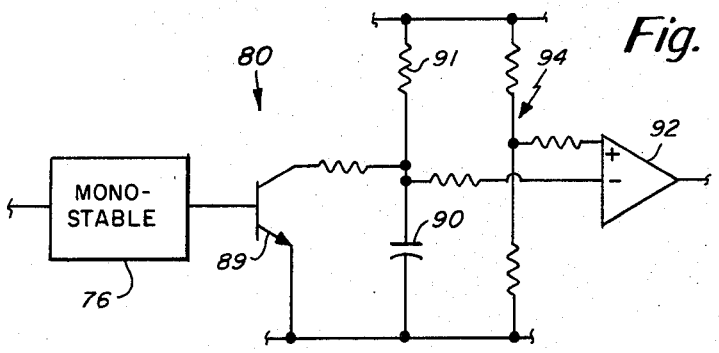
FIG. 4 shows a detail of a part of the circuit of FIG. 3 including the integrator/comparator.

Both the pre-alarm (outputs A) and the main alarm (outputs B) from both detectors couple to four input OR gate 72. The OR gate 72 thus detects activation of any pre-alarm or full alarm signal. The output of the gate 72 couples to a monostable device 76 whose output is arranged to disable the integrator/comparator 80. The detail of the monostable device 76 and the integrator/comparator 80 is shown in FIG. 4. The output of the monostable device 76 is arranged to be normally at its high state awaiting a reversion to its low state upon a detection. With the output of the monostable device 76 at its high state, this causes transistor 89 to be conductive clamping capacitor 90 to a low voltage level which may be near ground. The voltage across capacitor 90 is coupled to comparator 92 at one of its inputs. The other input to comparator 92 is coupled to the resistor string 94 for setting some predetermined reference voltage. When the capacitor 90 is clamped or essentially discharged because of the conduction of transistor 89 then the input from the capacitor 90 to the comparator 92 is well below the threshhold level established by the resistive network 94. In that state, the output of the comparator 92 may be considered as being at its low unactivated level. When a pre-alarm condition occurs on either channel at either output A then the output of the monostable device 76 goes to its low state causing transistor 89 to switch off thus permitting capacitor 90 to charge. The duration over which the monostable device 76 has this low output is dependent upon the maintenance of the input signals to the gate 72. Thus, if the pre-alarm condition ceases soon after it was initiated, the output of the device 76 goes back to its high state causing transistor 89 to rapidly discharge capacitor 90. If the pre-alarm condition again arises, then the capacitor 90 starts its timing cycle from its zero reference as established by voltage established thereacross when transistor 89 is conductive. If the pre-alarm condition persists, then capacitor 90 will eventually charge to a value sufficient to trip the comparator 92. This will occur after some predetermined delay period as established by the value of the capacitor 90, and the setting of the resistor network 94. The delay can be made variable also by controlling the current into capacitor 90 such as by changing the value of the series resistor 91 or by altering the current in some other fashion. For example, a current source of known design could replace the resistor 91.

Because under normal operation a pre-alarm always occurs before a full alarm, it may seem redundant to have both the pre-alarm and full alarm inputs into the gate 72. However, as an extra measure of reliability and in case of any malfunction of the pre-alarm inputs, then also the full or main alarm inputs are coupled to the gate 72.

The output of the device 80 couples to a further monostable device 78, to AND gate 68 and also to AND gate 70. A first condition that can be discussed is where there is only a pre-alarm condition from either of the two channels. Once the comparator 80 is triggered, this signal is coupled to the monostable device 78 causing it to change state from say a high level to a low level. The monostable device 78 is of the type that will remain in its low or activated state depending upon the time constant of the device which may be, for example, 0.5 seconds. Thus, the monostable device 78 is different than a monostable device 76 in that the device 76 tracks the output of the gate 72 while the device 78 operates independently and will have its output for a duration dependent upon the setting of the device and not dependent upon the input to the device. This predetermined width signal from the device 78 is inputted to OR gate 84 whose output connects to the positive supply line 88 by way of the limiting resistor 86. Thus, for a pre-alarm condition there is a current demand by way of resistor 86 made on the supply line for a given period of time determined by the time constant of the monostable device 78.

Another path from the output of device 80 is to the AND gate 68 which receives main alarm signals on outputs B from both detectors 64 and 66. Thus, the output from gate 68 is for the detection of a condition wherein both detectors have a full alarm. These full alarm signals are ANDed with the output of device 80 and thus there will be an output from gate 68 only when there is at least a pre-alarm persisting from at least one of the detectors for a period of time as set by the device 80. Thus, although gate 68 is essentially enabled as long as only one detector has reached its pre-alarm threshhold, there is only an output signal from the gate 68 when both detectors have reached the alarm threshhold.

In FIG. 3 there are shown different switches or links which are identified in FIG. 3 as links 1–4. These links may be opened or closed for providing different conditions. Thus, if it is desired to send a signal only when both detectors operate, then link 1 is closed. The signal from gate 68 can then progress along two different paths either to the code or pulse generator 82 or by way of link 3 directly to the gate 84. If the signal is coupled by way of the generator 82 then link 4 is closed and link 3 is left open. The pulse or code generator 82 may be of conventional design and is for impressing a coded or pulsed signal onto the line 88 by way of the resistor 86. If the generator 82 is tied into the circuit, then a particular coded signal is used to indicate the operation of both main detectors. Generator 82 may be a Supertex ED-15 or ED-11.

An alternate path from the device 80 is to the gate 70. The input of gate 70 also receives a signal from OR gate 74. Both inputs to gate 74 are full alarm inputs but gate 74 will have an active output if either of the main detectors has a full alarm. Such a signal is ANDed with the output of device 80 in the gate 70. Thus, by opening link 1 and closing link 2 a main alarm output is obtained if either of the detectors has an alarm. This signal also couples alternatively to either the generator 82 or by way of link 3 to the gate 84.

Figure 5A:
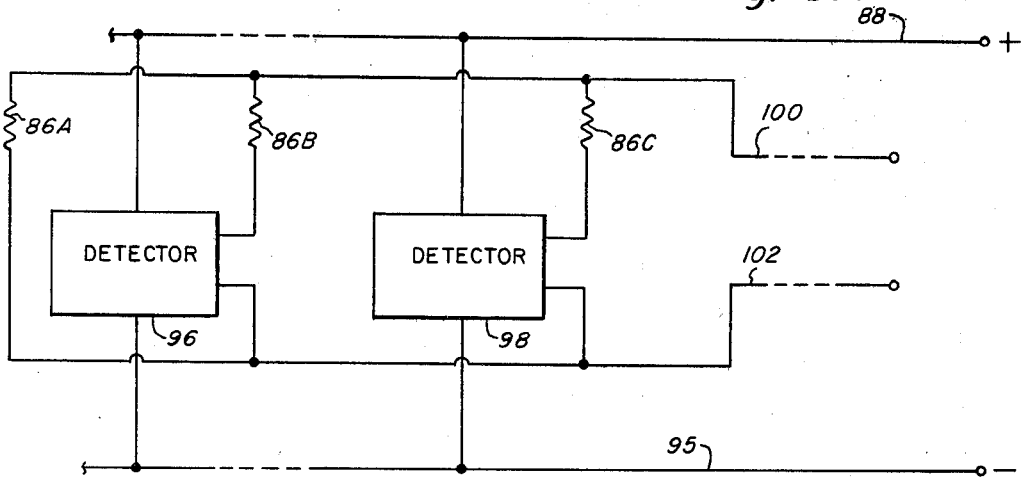
FIG. 5A shows an alternate embodiment of the present invention showing separate power lines and sensing lines.

In FIG. 3 the alarm signal by way of resistor 86 is coupled to the power supply line 88. However, in alternate embodiments a separate signal line may be provided such as shown in FIG. 5A. In FIG. 5A there are shown detector units 96 and 98, each of which may be substantially the same as the apparatus shown in FIG. 3. Thus, each of the detector units may include optical detection apparatus and ionization detection apparatus. Each of the detectors couples by way of a resistor and FIG. 5A shows an end of line resistor 86A and also resistors 86B and 86C associated respectively with detectors 96 and 98. The detector units 96 and 98 are powered by means of the power lines 88 and 95. FIG. 5A also shows the signal lines 100 and 102. The line 102 may be considered as a common line coupling to resistor 86A and detector units 96 and 98. The other signal line 100 receives signals from the resistors 86B and 86C upon actuation of either of the detector units.

Figure 5B:
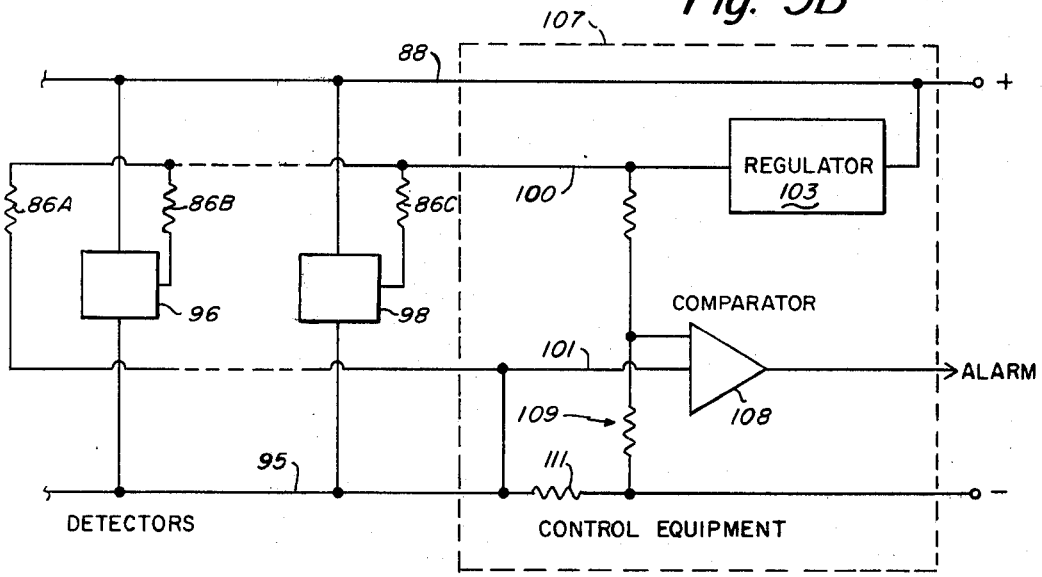
FIG. 5B shows still another embodiment of the present invention wherein the signal line is powered from the power line.

The diagram of FIG. 5B is similar to the one shown in FIG. 5A but also includes the control equipment box 107 shown in dotted outline. This equipment includes a regulator 103, comparator 108 and resistor network 109. In FIG. 5B the detectors 96 and 98 may be of substantially the same construction as shown in FIG. 3. The flow of current through resistors 96B or 96C is detected by the control equipment of FIG. 5B. When either one of the detectors is operated, the resistor such as resistor 86C is essentially switched across conductor lines 100 and 95. This causes current to be drawn through the sensing resistor 111 of the resistor network 109. When this occurs, the voltage at the input to comparator 108 from line 101 increases and causes the comparator output voltage to change causing an alarm condition signal at the output thereof. The comparator output goes to a low state if the resistor 86C or 86B is switched into the circuit. If the inputs to the comparator 108 are reversed, then the output would go from a low to a high state upon detection.

With reference to FIG. 5B and also FIG. 3, it has been previously mentioned that the monostable device 78 provides, for example, a 0.5 second signal which, with regard to FIGS. 5B, might cause a current through resistor 86C for 0.5 seconds. In order to discriminate between full alarm signal, which may remain low until the detector is set, there may be provided known means for discriminating between pulse widths. This may involve a simple integrator circuit connected from the alarm output of comparator 108.

Figure 6:
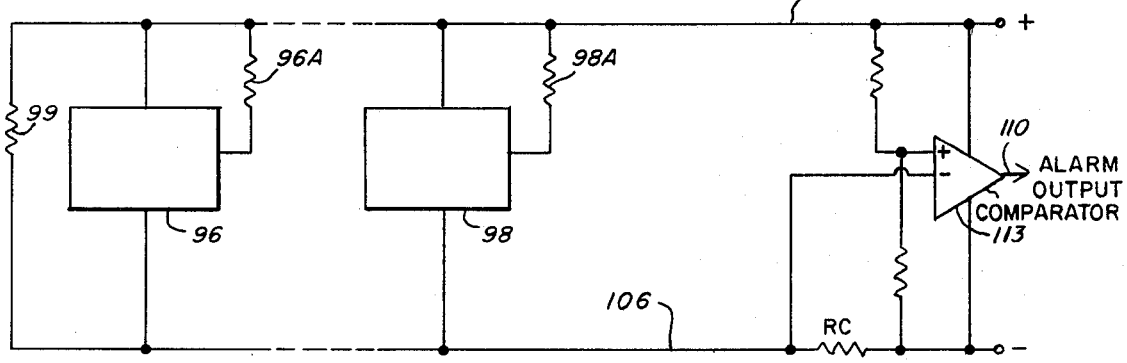
FIG. 6 shows a further embodiment of the invention in the form of a two-wire system.

FIG. 6 shows a basic two-wire system including detector units 96 and 98 associated limiting resistors 96A and 98A respectively. There is also provided an end-of-line resistor 99. The detector units couple to the power lines 105, 106. When one of the detector units is activated, then the associated resistor, such as resistor 98A is coupled across the lines 105, 106. This condition is sensed by the control resistor RC which is essentially connected across the input of the comparator 113. Thus, upon activation of one of the detector units the voltage developed across resistor RC is sensed by comparator 113 to provide an output signal at the output alarm terminal 110. A trouble condition at the detector unit may be indicated by the detector being turned on for a period of time such as say 20 milliseconds. This is a sufficient time for sensing by the detection unit including device 113 and resistor RC. Conventional pulse width detection and discriminating circuitry can also be used in association with the trouble line detection.

In FIG. 6 the output on line 110 depends upon the type of signal that is coupled from the detector units 96 and 98. For example, a shorter duration signal may indicate a pre-alarm condition while a longer duration signal may indicate a full alarm condition.

In some of the embodiments of the invention such as shown in FIG. 6 each detector may be strobed as described in one of my prior patents identified herein. The output level appears for the duration of the strobe period when there is no alarm. In accordance with another feature of this invention it is desirable to detect the analog output of the detector which is only available during the strobe period. Normally, the strobe period is not sufficiently long to take the reading. In order to retain this analog reading, it is proposed in accordance with the present invention to provide a sample and hold circuit to be used in association with the detector.

Figure 7:
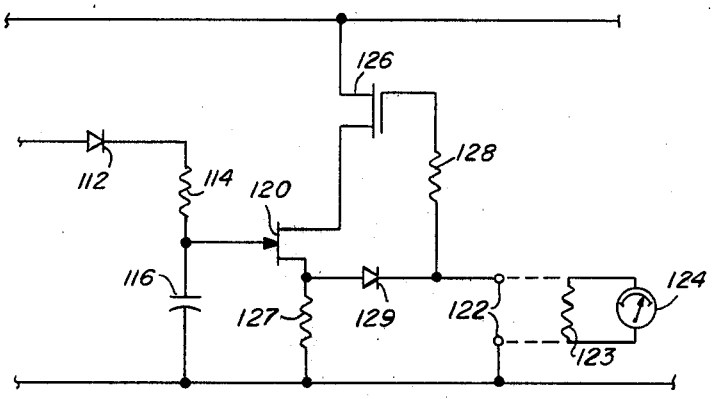
FIG. 7 is a circuit diagram showing a preferred version of a circuit for feeding the analog output from either detector.

In order to obtain the analog reading without causing continuous drain from the detector, the circuit shown in FIG. 7 is preferred. FIG. 7 shows the strobed analog output which may be an output from, for example, amplifier 26 shown in FIG. 1A. This output is coupled by way of diode 112, resistor 114 and capacitor 116 to the control electrode of FET transistor 120. FIG. 7 also shows the output terminals 122 which may couple to a remote meter 124. In series with transistor 120 is a second transistor 126. The circuit including resistors 127 and 128 and diode 129 normally holds transistor 126 in its non-conductive state. This condition also means that transistor 120 is non-conductive. Every time that the detector is strobed, the capacitor 116 is refreshed and stores the peak voltage by way of diode 112 and resistor 114. However, because transistor 120 is not conductive, the output is not available at the output terminals 122. However, once the remote resistor 123 and meter 124 are connected, the transistor 126 is permitted to conduct and there is an output at the source electrode of transistor 120. In the circuit of FIG. 7 an operational amplifier voltage follower can be used in place of transistor 120 and transistor 126. Also, the FET transistor 126 and resistor 128 can be replaced by a bipolar transistor circuit. Thus, in the circuit of FIG. 7 the sample and hold circuit including capacitor 116 is only gated when the reading is required.

Figure 8:
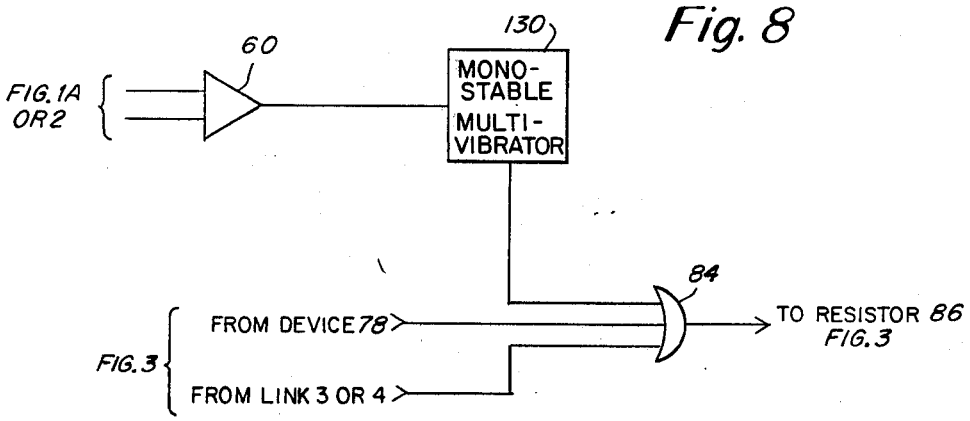
FIG. 8 is a logic diagram showing the means by which the trouble channel is incorporated into the system of FIG. 3.

In association with FIGS. 1A and 2 it was previously mentioned that there may also be provided a trouble channel C for indicating a fault condition associated with either detector. In this connection, note the comparators 60 and 62 shown in FIGS. 1A and 2, respectively. FIG. 8 shows one of these comparators 60 which couples to a monostable multivibrator 130 which may have a time constant of 20 milliseconds as discussed previously in connection with the description of FIG. 6. The device 130 couples to a third input of gate 84. In this connection refer to FIG. 3 which shows the gate 84 having only two inputs. With the third input there could be a further signal to the resistor 86 of FIG. 3 to signal a further condition such as a trouble condition with either section of the detector. As indicated in FIG. 8 the other inputs to the gate 84 are from device 78 and either from link 3 or link 4 depending upon the connection of these links.

What is claimed is:

1. A combination detector for detecting smoke or fire conditions, comprising;

optical detection apparatus comprising an optical transmitter/receiver transducer means and optical detection circuitry coupled from said transducer means for sensing activation thereof and for providing an electrical signal representative of optical transducer means output, ionization detection apparatus comprising an ionization chamber means and ionization detection circuitry coupled from said ionization chamber means for sensing operation thereof and for providing an electrical signal representative of ionization chamber means output, first trigger comparator means associated with the optical detection apparatus and including a pre-alarm optical comparator having a pair of comparison inputs and a full alarm optical comparator also having a pair of comparison inputs, means establishing a fixed reference voltage input at one input to the pre-alarm optical comparator, means establishing a fixed reference voltage input at one input to the full alarm optical comparator, means coupling the electrical signal representative of optical transducer means output to the other input of both the pre-alarm and full alarm optical comparators, second trigger comparator means associated with the ionization detection apparatus and including a pre-alarm ionization comparator having a pair of comparison inputs and a full alarm ionization comparator also having a pair of comparison inputs, means establishing a fixed reference voltage input at one input to the pre-alarm ionization comparator, means establishing a fixed reference voltage input at one input to the full alarm ionization comparator, means coupling the electrical signal representative of ionization chamber means output to the other input of both the pre-alarm and full alarm ionization comparators, and output circuit means for receiving signals from said pre-alarm optical and ionization comparators and said full alarm optical and ionization comparators for providing at least one alarm signal in response to triggering of at least one of said comparators.

2. A combination detector as set forth in claim 1 wherein said output circuit means comprises AND gate means for receiving an output signal from both the full alarm optical comparator and the full alarm ionization comparator for providing an alarm signal when both said full alarm comparators are triggered.

3. A combination detector as set forth in claim 1 wherein said output circuit means comprises OR gate means having inputs from at least the pre-alarm optical and ionization comparators for providing an alarm signal when either of said pre-alarm comparators is triggered.

4. A combination detector as set forth in claim 3 comprising timing circuit means coupled from said OR gate means and adapted to have an inoperative output when the OR gate means has an inoperative output and switched to an operative state after the OR gate means has sustained its operative output for a predetermined delay period.

5. A combination detector as set forth in claim 4 wherein said OR gate means has inputs also from said full alarm optical and ionization comparators.

6. A combination detector as set forth in claim 5 wherein said timing circuit means comprises a monostable multivibrator having an output that tracks the OR gate means output and a charging circuit coupled from the monostable multivibrator.

7. A combination detector as set forth in claim 6 including a second monostable multivibrator having a preselected output coupled from the charging circuit to provide a pulse alarm signal.

8. A combination detector as set forth in claim 7 including a second OR gate means having one input coupled from the output of the timing circuit means.

9. A combination detector as set forth in claim 8 including a third OR gate means for receiving said full alarm optical and ionization comparator outputs, and a second AND gate means having one input coupled from the third OR gate means and another input coupled from said charging circuit.

10. A combination detector as set forth in claim 9 including alarm generating means, first linking means coupled from the first AND gate means to the alarm generating means and second linking means coupled from the second AND gate means to the alarm generating means.

11. A combination detector as set forth in claim 10 including third linking means coupled from the first linking means to the second OR gate means and fourth linking means coupling the output of the alarm generating means to the second input of the second OR gate means.

12. A combination detector as set forth in claim 1 wherein said output circuit means comprises AND gate means for receiving an output signal from both the full alarm optical comparator and the full alarm ionization comparator for providing an alarm signal when both said full alarm comparators are triggered, OR gate means having inputs from at least the pre-alarm optical and ionization comparators for providing an alarm signal when either of said pre-alarm comparators is triggered, and timing circuit means coupled from said OR gate means and adapted to have an inoperative output when the OR gate means has an inoperative output and switched to an operative state after OR gate means has sustained its operative output for a predetermined delay period.

* * * * *